United States Patent [19]

Hayes

[11] 4,432,471

[45] Feb. 21, 1984

[54] TWO PHASE PRODUCT DISPENSER

[75] Inventor: Harry Hayes, Warrington, England

[73] Assignee: Colgate-Palmolive Company, New York, N.Y.

[21] Appl. No.: 307,460

[22] Filed: Oct. 1, 1981

[51] Int. Cl.[3] ..... B67D 5/54

[52] U.S. Cl. ..... 222/136; 222/263; 222/386.5; 222/389

[58] Field of Search ..... 222/136, 209, 211, 214, 222/394, 386.5, 389, 129, 94, 95, 252, 263, 26; 239/303, 304, 310, 313, 323

[56] References Cited

U.S. PATENT DOCUMENTS

| | | | |
|---|---|---|---|
| 1,772,425 | 8/1930 | Lebecque et al. | 222/401 |
| 3,198,438 | 8/1965 | Hultgren | 222/389 X |
| 3,704,814 | 12/1972 | Ruscitti | 239/304 X |
| 3,895,738 | 7/1975 | Buchanan et al. | 222/26 |

FOREIGN PATENT DOCUMENTS

| | | | |
|---|---|---|---|
| 449894 | 7/1949 | Italy | 222/209 |

*Primary Examiner*—Joseph J. Rolla
*Assistant Examiner*—Kevin P. Shaver
*Attorney, Agent, or Firm*—Herbert S. Sylvester; Murray M. Grill; John A. Stemwedel

[57] ABSTRACT

A dispenser comprising a container having an upper section and a lower section. A perforated plate separates the upper section from the lower section. A first product is within the lower section with an air space existing between the first product and the plate. A deformable membrane or pliable bag overlies the plate. A second product is in the upper section with the membrane or bag separating the second product from the plate. A lower delivery tube section is connected to the lower section of the container, an upper delivery tube section being connected to said upper section of the container. There is a nozzle communicating with the delivery tube sections, and a pump on the container for introducing air under pressure into the air space for simultaneously forcing the first and second products through the nozzle.

13 Claims, 3 Drawing Figures

FIG. 1
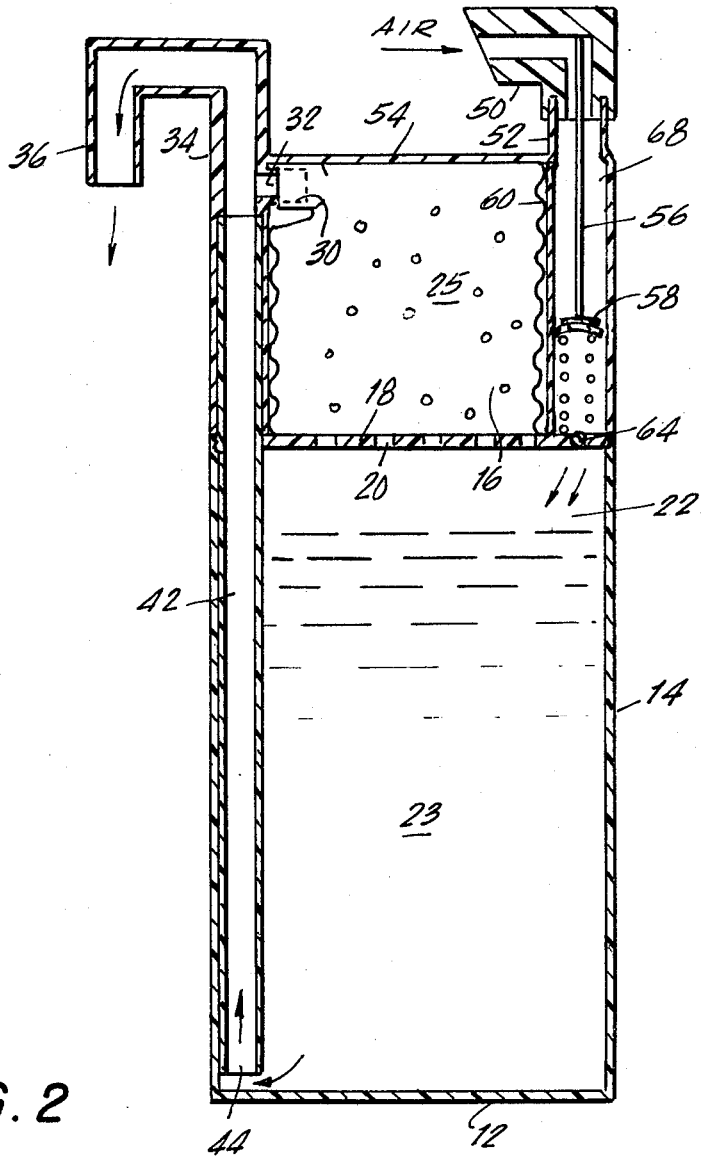
FIG. 2
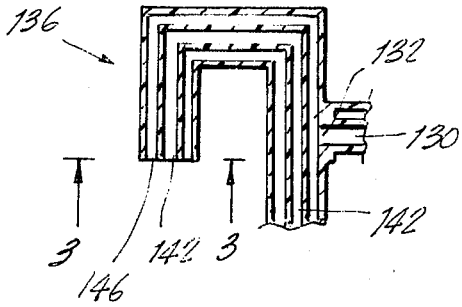
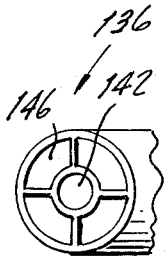
FIG. 3

TWO PHASE PRODUCT DISPENSER

BACKGROUND OF THE INVENTION

1. Field of the Invention

This invention relates to a toothpaste dispenser, and more particularly to a freely standing packaging device for keeping two phases apart in a container until immediately before use.

2. Description of the Prior Art

Traditionally dental creams are packaged in collapsible aluminum or laminated tubes. Rigid freely standing packages for single phase dental creams have now come into use and are now being sold in West Germany under the trademark: "Theramed" and "Anti-Belag". One packaging device so employed is disclosed in German Pat. No. 1,210,140.

Various other types of packaging using pumping means for dispensing dental cream have been devised. In U.S. Pat. No. 2,604,858 to Bosa there is disclosed a positive acting assembly for use in a pump type dispenser. Various types of dispensers for dispensing two phase products have also been devised such as shown in U.S. Pat. No. 2,789,731 to Marraffino, and in U.S. Pat. No. 3,608,782 to Sethieq.

The prior art fails to provide for a simple, aesthetically pleasing, free standing toothpaste dispenser that employs a container having a pair of separate compartments which uses an air pump input to simultaneously discharge two separate phases of dental cream to a nozzle for mixing only at the nozzle.

U.S. Pat. No. 3,097,766, Biehl, et al discloses a pressurized intermediate cavity. Ermech, U.S. Pat. No. 3,120,330, contemplates using a container over an apertured disc. Moskovitz, U.S. Pat. No. 3,031,104, employs a membrane, while Farrar et al, U.S. Pat. No. 3,217,931, and Visceglia et al, U.S. Pat. No. 3,992,003, both discloses two phase dispensers.

SUMMARY OF THE INVENTION

The present invention resides in a dispenser comprising a container having an upper section and a lower section, a perforated plate separating said upper section from said lower section, first product within said lower section with an air space existing between said first product and said plate, a deformable membrane means overlying said plate, second product in said upper section with said membrane means separating said second product from said plate, a lower delivery tube section connected to said lower section of said container, an upper delivery tube section connected to said upper section of said container, nozzle means communicating with said delivery tube sections, and pump means on said container for introducing air under pressure into said air space for simultaneously forcing said first product and the second out of the delivery nozzle.

BRIEF DESCRIPTION OF THE DRAWING

FIG. 1 is a vertical sectional view through an embodiment of the invention.

FIG. 2 is a partial sectional view of another embodiment of the invention showing a different nozzle assembly.

FIG. 3 is a sectional view of the nozzle of FIG. 2 taken along line 3—3.

DETAILED DESCRIPTION OF THE INVENTION

The invention resides in a freely standing hollow container 10 having a bottom 12, and a lower container section 14 separated from an upper container section 16 by a perforated plate 18 having air openings 20 therethrough.

A first product or phase 23 is disposed in the lower container section 14 below said plate leaving an air space 22 below the plate 18. A second product 25 is disposed in the upper container section 16 and separated from said plate by a suitable membrane such as a pliable plastic bag 28 or sheet. The bag 28 contains the second phase 25 and has an opening 30 communicating with a delivery opening 32 connected to an upper delivery tube section 34 which in turn is connected to a delivery nozzle 36.

At the bottom of the lower container section 14 there is the inlet 44 of the lower delivery tube section 42.

A combined air inlet nozzle and actuator 50 is vertically slidably mounted on the neck 52 from the top 54 of container 10 connected to the actuator 50 is a pump assembly having a tube 68 containing a plunger 56 having a pump head 58 which works with a spring 66 or the like mounted above plate 18 to form a pump. A one way valve 64 is fitted in plate 18 to permit passage of air into air space 22 but not permitted return.

In use actuation of the actuator 50 forces air into the air space 22 forcing product 23 through lower delivery tube section 42 while simultaneously forcing air through openings 20 to squeeze bag 28 thereby forcing product 25 through opening 32 into the upper portion of delivery tube 42 and out of nozzle 36.

In the embodiment of FIG. 2, a concentric nozzle arrangement is shown wherein lower delivery tube 142 passes through upper delivery tube 146, to deliver product in a coaxial fashion as is best seen in FIG. 3.

In the use of this embodiment, actuation of the pump actuator 50 forces air into the air space 22 forcing product 23 through lower delivery tube section 142 while simultaneously forcing air through openings 20 to squeeze bag 28 thereby forcing product 25 through opening 132 into upper delivery tube 146 and coaxially out of nozzle 136.

What is claimed:

1. A dispenser comprising a container having an upper section and a lower section, a perforated plate separating said upper section from said lower section, first product within said lower section with an air space existing between said first product and said plate, deformable membrane means overlying said plate, second product in said upper section with said membrane means separating said second product from said plate, a lower delivery tube section connected to said lower section of said container, an upper delivery tube section connected to said upper section of said container, nozzle means communicating with said delivery tube sections, and pump means on said container for introducing air under pressure into said air space for simultaneously forcing said first product and said second product through said nozzle.

2. A dispenser according to claim 1, wherein said lower delivery tube section is connected to said lower container section adjacent the bottom of said lower container section.

3. a dispenser according to claim 1, wherein said upper delivery tube section is connected to said upper container section adjacent the top of said container.

4. A dispenser according to claim 1, wherein said lower delivery tube section is connected to said lower container section adjacent the bottom of said lower container section, said upper delivery tube being connected to said upper container section adjacent the top of said container.

5. A dispenser according to claim 1, wherein said membrane means comprises a pliable bag having an opening aligned with said upper delivery tube section.

6. A dispenser according to claim 1, wherein said lower delivery tube section is connected to said lower container section adjacent the bottom of said lower container section, said upper delivery tube section being connected to said upper container section adjacent the top of said container, said membrane means comprising a pliable bag having an opening aligned with said upper delivery means.

7. A dispenser according to claim 1, wherein said pump includes a combined actuator and air intake nozzle, a neck on said container having said combined nozzle and actuator movably mounted thereon.

8. A dispenser according to claim 1, wherein said upper delivery tube section and said lower delivery tube extend coaxially through the nozzle.

9. A dispenser according to claim 7, wherein said pump further includes a tube above said plate, a plunger extending into said tube and connected to said actuator, and valve means for permitting flow from said pump into said air space below said plate.

10. A dispenser according to claim 9, wherein said lower delivery tube section is connected to said lower container section adjacent the bottom of said lower container section.

11. A dispenser according to claim 9, wherein said upper delivery tube section is connected to said upper container section adjacent the top of said container.

12. A dispenser according to claim 9, wherein said lower delivery tube section is connected to said lower container section adjacent the top of said container, said upper delivery tube section being connected to said upper container section adjacent the top of said container.

13. A dispenser according to claim 12, wherein said membrane means comprises a pliable bag having an opening aligned with said upper delivery tube section.

* * * * *